United States Patent [19]

Guimarin

[11] 4,345,696

[45] Aug. 24, 1982

[54] CONTAINER OPENING APPARATUS

[75] Inventor: Henry L. Guimarin, Irving, Tex.

[73] Assignee: Guimarin Container Co., Incorporated, Dallas, Tex.

[21] Appl. No.: 208,589

[22] Filed: Nov. 20, 1980

[51] Int. Cl.[3] ..... B65D 17/42

[52] U.S. Cl. ..... 220/277; 220/258

[58] Field of Search ..... 220/258, 267, 270, 277, 220/259

[56] References Cited

U.S. PATENT DOCUMENTS

| | | | |
|---|---|---|---|
| 3,383,007 | 5/1968 | Salamone | 220/277 |
| 3,726,432 | 4/1973 | Gentile | 220/258 X |
| 4,141,464 | 2/1979 | Kelley et al. | 220/277 X |

*Primary Examiner*—George T. Hall

*Attorney, Agent, or Firm*—Kanz & Timmons

[57] ABSTRACT

Disclosed is apparatus for forming an opening in a sealed container. A score or weakening groove is formed in the container end to define a tab which includes a raised boss. An opening bar movable with respect to the container but affixed thereto is moved over the container end to contact the raised boss. The tab is thus depressed into the container and severed along the weakening groove to form an opening. The opening bar is positioned over the tab during shipment and during the initial opening procedure to protect the tab during shipment and to protect the user from the contents of the container during the initial opening procedure.

11 Claims, 4 Drawing Figures

CONTAINER OPENING APPARATUS

This invention relates to fluids containers. More particularly, it relates to fluids containers with self-contained apparatus for forming an opening in such containers.

Various materials such as liquids and liquids containing dissolved gasses, as well as granular or powdered materials and the like, are commonly sold to the consuming public in convenience-sized sealed containers. Many such containers, such as those used for beverages and the like, are hermetically sealed to retain dissolved gasses, etc., within the container. The contents of such containers are usually consumed immediately after opening the container, thus it is unneccessary to re-seal the container. Therefore, any means for forming an opening in the container is suitable for removing the contents therefrom. However, it has become common practice to include convenient self-opening apparatus with the container so that the container may be readily opened when desired without resorting to use of separate opening tools.

Heretofore the most common self-contained means for opening such containers results in the complete separation and removal of a tab from the end of the container to form an opening.

Commonly, a metal container end, made of aluminum or aluminum alloy, is scored to form a weakening groove in the container end which defines a removeable tab. A leverage ring or the like is attached to the tab thus defined so that when the ring is raised or pulled, the container end is torn along the weakening groove and the tab separated and removed from the container end.

Removal of the tab by tearing the tab outwardly with respect to the container results in forming a somewhat jagged sharp edge on the opening. More importantly, when the tab and leverage ring are removed from the container, they are usually discarded and present an ecological hazard. Accordingly, in order to avoid the ecological hazard, it is desirable that alternative self-opening means be provided wherein the tab defining the opening remains attached to the container. Various attempts have been made at designing such self-contained opening systems, all of which have certain limitations and some of which have met with limited success.

In accordance with the present invention, a self-opening container is provided which includes a weakening groove formed in the end of the container to define a tab which, when removed, defines an opening through which the contents may be removed. Moreover, the apparatus of the invention includes opening apparatus attached to the container end which co-operates with the pre-formed groove and tab defined thereby to depress the tab into the container. The opening apparatus is affixed to the end of the container and rotatable with respect thereto so that upon rotation of the opening apparatus the tab defined by the weakening groove is depressed into the container to form an opening. However, the tab remains attached to the container. The opening apparatus further provides protective means which covers the weakening groove area during shipment of the container, thereby preventing the weakening groove and tab defined thereby from accidental opening during shipment and also protecting the area surrounding the opening to be formed from contamination by foreign materials. Furthermore, since the opening apparatus depresses the tab defined by the weakening groove inwardly, the opening tab need never be touched by the user. As an additional advantage, the opening apparatus surrounds the opening at the time the initial seal is broken. Therefore, the user of the apparatus is protected from escaping gasses or liquids contained under pressure in the container during opening.

Other features and advantages of the invention will become more readily understood when taken in connection with the appended claims and attached drawings in which:

For clarity and convenience of illustration, the invention will be described herein with particular reference to use in connection with conventional aluminum or aluminum alloy end pieces as employed in connection with cylindrical container tubes for carbonated beverages. It will be readily appreciated, however, that the invention is not so limited and may be employed in connection with various other containers of various dimensions and shapes and for containing various other goods.

Figure 1:
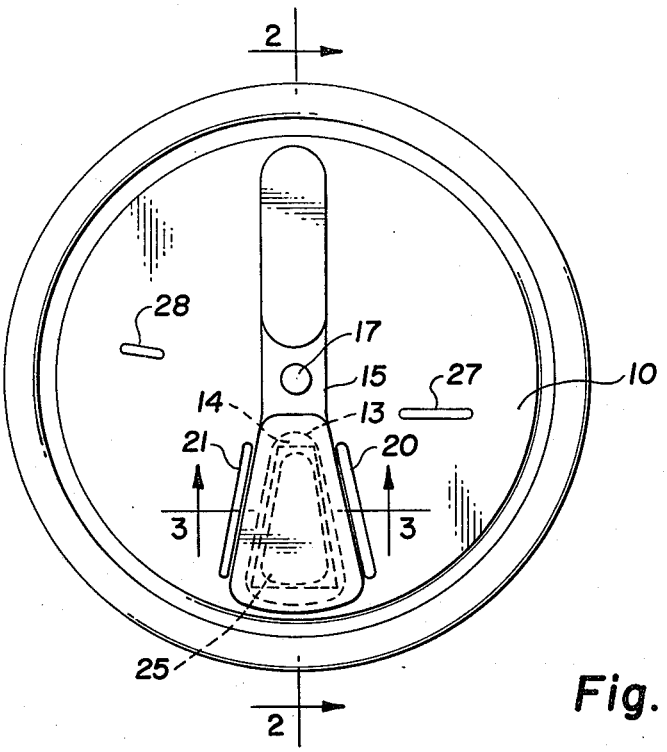
FIG. 1 is a top plan view of a container end employing the preferred embodiment of the opening apparatus of the invention.
Figure 2:
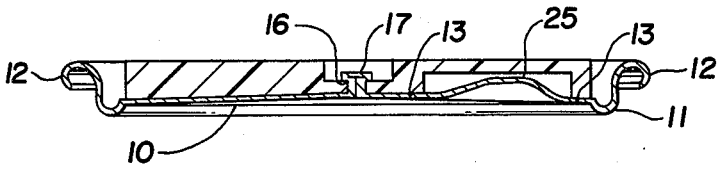
FIG. 2 is a sectional view of the container end of FIG. 1 taken through section lines 2—2.

As illustrated in FIGS. 1 and 2, the conventional container end of a beverage container consists of a substantially flat member in the form of a disc-like structure 10 conventionally referred to as an end. End 10 usually comprises a disc-like body curled upwardly and outwardly at the peripheral edge thereof to form an annular shoulder 11 with an outwardly curved lip 12. The lip 12 and shoulder 11 are conventionally designed to mate with an outwardly flared end on a metal tube or the like (not illustrated) and joined to the tube by a conventional rolled double seam seal. The end, of course, may be formed in various other suitable configurations to mate with other containers. Since the method and structure for joining the end to the container tube form no part of this invention and are well known to those skilled in the art, further description thereof is unneccessary.

As in conventional self-opening containers, the end 10 is scored to form a weakening groove 13 in the surface of the end 10 which defines a tab 14. Weakening groove 13 structurally weakens the end 10 along groove 13 so that upon application of sufficient pressure the tab 14 may separate from the end 10 along weakening groove 13 thereby forming an opening in the end 10. In the embodiment illustrated, the tab 14 is substantially triangular with rounded curves in plan view to form a triangular or somewhat tear-drop shaped opening with the wider portion thereof disposed toward the rim of the container. It will be observed that in conventional tear-open container ends, the weakening groove is formed on the underside of the disc so that the tab may be torn outwardly. This, of course, results in a somewhat jagged torn edge on the opening with the tear edges projecting upwardly. In contrast, in the preferred embodiment of the present invention, the groove or score line 13 is formed on the upper or outer surface of the end 10 and the tab 14 is torn inwardly. Accordingly, any jagged edges formed by tearing the tab along the score line or groove 13 will project inwardly and away from the user. The score line may, of course, be formed on either or both major faces of the end.

As illustrated in FIG. 1, an opening bar 15 is pivotally attached to the end 10. In the preferred embodiment, the opening bar is an elongated member having a central aperture 16 which mates with a pin or upwardly extending protrusion 17 passing through aperture 16 which is flattened on the upper end thereof to securely rotatably affix the opening bar 15 to the top surface of the end 10.

In preferred embodiment, the vertical thickness of opening bar 15 is no more than (and preferably less than) the vertical height of the surrounding upstanding bead on the end of the container so that the containers may be stacked as with conventional beverage containers. Accordingly, and for the same reason, the length of the opening bar 15 should be slightly less than the diameter of the container end inside the shoulder.

As illustrated in FIG. 1, the pin 17 about which the opening bar 15 rotates is centrally positioned in the end 10 and the opening bar 15 extends approximately equal distances in both directions therefrom. The underside of one end of the opening bar 15 defines a cavity 18 sufficiently wide to cover at least the entire area defined by weakening groove 13. With the opening bar 15 in the position illustrated in FIG. 1, the cavity 18 is aligned with tab 14 and the tab 14, as well as the area surrounding the groove 13, is covered by the opening bar 15.

Figure 3:
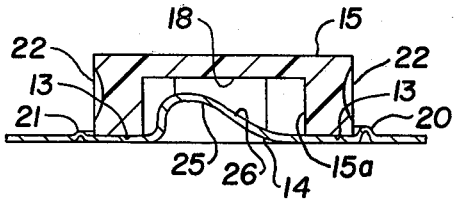
FIG. 3 is a partial sectional view of the apparatus of FIG. 1 taken through section lines 3—3.
Figure 4:
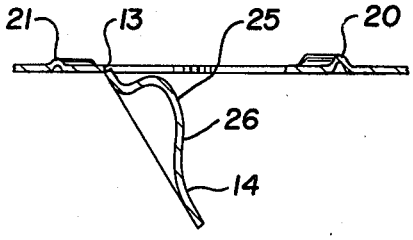
FIG. 4 is a partial sectional view of the container end of FIG. 3 taken along section lines 3—3 illustrating the position of the opening tab after the container has been opened.

To maintain the opening bar in the position illustrated in FIG. 1 during transit, etc., bosses 20 and 21 are formed in the end 10 to protrude slightly upwardly and parallel to the radially extending edges of the opening bar 15. As illustrated in FIGS. 3 and 4, boss 20 extends slightly higher than boss 21. Thus, the bosses 20 and 21 prevent accidental rotation of the opening bar about the pivot pin 17. Boss 20 is higher than boss 21 so that the bar may not be rotated counter-clockwise as shown in FIG. 1. However, by slightly lifting the end of opening bar 15, the edge of opening bar 15 may pass over boss 21, thereby permitting rotation of the opening bar 15 clockwise when desired. For aid in lifting the opening bar for rotation over boss 21, indentations 22 may be formed in the vertical sides of the opening bar 15. Therefore, the end of the opening bar 15 may be slightly lifted by gripping the bar 15 and lifting upwardly sufficiently for the edge of the bar to pass over boss 21 and applying lateral pressure to the opposite side of the bar and to the opposite end of the bar.

As illustrated in FIG. 3, the tab 14 defined by groove 13 is deformed upwardly in the central portion thereof to form an inclined boss 25. As illustrated in FIGS. 3 and 4, the inclined boss 25 slopes upwardly from groove 13. Accordingly, when the opening bar 15 is rotated clockwise as shown in FIG. 1, the inside surface **15*a* of cavity 18 engages the inclined surface 26 of the inclined boss 25, thereby urging tab 14 downwardly. When sufficient pressure is applied to inclined surface 26, the tab 14 begins to separate from the end 10 along the weakening groove 13. As the opening bar 15 is further rotated, the tab 14 is progressively separated from the end 10 along the weakening groove 13 until the opening bar 15 passes over inclined boss 25. Since the inclined boss 25 must be depressed below the plane of the end 10, the tab 14 is separated along weakening groove 13 along all sides except the extreme left-hand side (as viewed in FIGS. 3 and 4) and thus projects inwardly into the container. However, since the tab 14 is not separated from the end 10 along the one remaining edge, the tab 14 is hinged downwardly and supported within the container. It will be observed that since the tab 14 is not totally separated from the container (but merely bent inwardly and remains attached along one edge thereof), the tab 14 cannot be separately discarded. Furthermore, it should be observed that since only the internal surface 15*a* of the cavity 18 (instead of the operator's hands) contacts the tab 14, the goods contained within the container are not contaminated by the operator's hands. Moreover, since the entire area surrounding the tab 14 is protected by the opening bar 15 until the container is opened, foreign materials may not contaminate the area around the tab 14 or the opening formed thereby. As an additional advantage, it will be observed that when the initial opening sequence is begun, the opening is confined and covered by the cavity 18 in the opening bar. Thus, if the contents of the container are under pressure, the contents escaping through the initial opening formed are released into the cavity 18**. Therefore, gas pressure contained within the container may be vented without spraying the contents of the container on the consumer.

It is, of course, common practice for consumers of beverages contained in conventional containers to drink the beverage directly from the opening formed in the container. It will be observed that in the present invention, the area surrounding the opening is maintained uncontaminated by the opening bar until the container is opened. Therefore, the liklihood of contamination of the container end surrounding the opening is greatly reduced. Furthermore, the tab 14 and the opening bar 15 are permanently attached to the container so that the entire container may be discarded as a unitary component.

In order to position the opening bar 15 so as not to interfere with the consumer who desires to drink the contents of the container directly from the opening, additional bosses 27 and 28 may be formed in the container end 10 as indicated in FIG. 1. In the preferred embodiment, boss 27 is positioned approximately 90° counter-clockwise from the center-line of tab 14 and is high enough to limit clockwise rotation of the opening bar 15 to approximately 90°. Boss 28 is almost diametrically disposed from boss 27 and is appropriately positioned so that the edge of the cavity 18 may be passed thereover when the opening bar 15 is lifted slightly and thereby locks the opening bar 15 in a position rotated approximately 90° from the opening formed by tab 14.

From the foregoing it will be observed that a container end incorporating the opening apparatus of the invention may be readily formed from suitable conventional materials, such as aluminum, other metals or alloys, and plastics. Furthermore, conventional container ends may be modified to incorporate the invention without adversely affecting conventional means for attaching the container ends to tubes to form a sealed container, and containers employing the invention may be stacked, packaged and shipped in conventional manner.

While the invention has been described with particular reference to beverage containers, it will be apparent to those skilled in the art that the principles thereof may be applied to other containers for other goods with like results. Accordingly, the form of the invention shown and described in detail is to be taken as the preferred embodiment of same. Various changes and modifications may be resorted to without departing from the spirit and scope of the invention as defined by the appended claims.

What is claimed:

1. In a container end including a substantially flat disc-like body member having an outer major surface and an inner major surface and adapted to mate with a container body to form a sealed enclosure, the improvement comprising:

(a) a partially severable tab defined by a weakening score line in said substantially flat member, said tab including at least one inclined boss projecting outwardly from said outer major surface; and (b) opening means comprising an elongated member disposed substantially diametrically across said end secured to said container adjacent said end and moveable in a plane substantially parallel with said outer major surface, said opening means covering said tab and said inclined boss;

whereby movement of said opening means in said plane substantially parallel with said outer major surface causes said opening means to engage said inclined boss and depress said tab inwardly into said container by at least partially severing said tab from said end along said weakening score line.

2. The improvement defined in claim 1 wherein said elongated member is secured to said container by pin means extending upwardly from the center of said end and is rotatable about said pin means.

3. The improvement defined in claim 1 including locking means to prevent accidental movement of said opening means with respect to said end.

4. The improvement defined in claim 3 wherein said locking means comprises at least one raised boss extending from said outer major surface and positioned to maintain said opening means in a position covering said tab.

5. The improvement defined in claim 4 wherein said opening means comprises an elongated body with a surface extending adjacent and substantially parallel with said outer major surface and has a cavity in said surface adjacent said outer major surface in registry with said tab and covering said tab and the area immediately surrounding said tab, and said locking means comprises bosses extending from said outer major surface on opposite sides of said elongated body.

6. The improvement defined in claim 5 wherein one of said bosses extends further from the surface of said outer major surface than the other of said bosses.

7. The improvement defined in claim 5 further including locking means for securing said opening means in a position removed from said tab.

8. In a container end including a substantially flat member having an outer major surface and an inner major surface and adapted to mate with a container body to form a sealed enclosure, the improvement comprising:

(a) a partially severable tab defined by a weakening score line in said substantially flat member, said tab including at least one inclined boss projecting outwardly from said outer major surface;

(b) opening means secured to said container adjacent said end moveable in a plane substantially parallel with said outer major surface, said opening means covering said tab and said inclined boss; and (c) locking means to prevent accidental movement of said opening means with respect to said end, said locking means comprising at least one raised boss extending from said outer major surface and positioned to maintain said opening means in a position covering said tab;

whereby movement of said opening means in said plane substantially parallel with said outer major surface causes said opening means to engage said inclined boss and depress said tab inwardly into said container by at least partially severing said tab from said end along said weakening score line.

9. The improvement defined in claim 8 wherein said opening means comprises an elongated body with a surface extending adjacent and substantially parallel with said outer major surface and has a cavity in said surface adjacent said outer major surface in registry with said tab and covering said tab and the area immediately surrounding said tab, and said locking means comprises bosses extending from said outer major surface on opposite sides of said elongated body.

10. The improvement defined in claim 8 wherein one of said bosses extends further from the surface of said outer major surface than the other of said bosses.

11. The improvement defined in claim 8 further including locking means for securing said opening means in a position removed from said tab.

* * * * *